US008343702B2

(12) United States Patent
Kim

(10) Patent No.: US 8,343,702 B2
(45) Date of Patent: Jan. 1, 2013

(54) ELECTROPHOTOGRAPHIC TONER AND METHOD OF PREPARING ELECTROPHOTOGRAPHIC TONER

(75) Inventor: In Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 136 days.

(21) Appl. No.: 12/854,250

(22) Filed: Aug. 11, 2010

(65) Prior Publication Data

US 2011/0171571 A1 Jul. 14, 2011

(30) Foreign Application Priority Data

Jan. 12, 2010 (KR) ..... 10-2010-0002744

(51) Int. Cl.
*G03G 9/08* (2006.01)

(52) U.S. Cl. ..... 430/109.1; 430/137.11

(58) Field of Classification Search ..... 430/109.1, 430/137.11

See application file for complete search history.

(56) References Cited

U.S. PATENT DOCUMENTS

| | | | | |
|---|---|---|---|---|
| 4,206,247 | A | 6/1980 | Mitsuhashi et al. | |
| 2008/0227002 | A1* | 9/2008 | Moriya et al. | 430/48 |
| 2009/0011355 | A1* | 1/2009 | Shibai | 430/109.1 |
| 2009/0297973 | A1 | 12/2009 | Iwamoto et al. | |

FOREIGN PATENT DOCUMENTS

| | | |
|---|---|---|
| JP | 54-002740 | 1/1979 |

OTHER PUBLICATIONS

EP Search Report issued Apr. 29, 2011 in EP Patent Application 10194477.5.

* cited by examiner

*Primary Examiner* — Mark A Chapman
(74) *Attorney, Agent, or Firm* — Stanzione & Kim, LLP

(57) ABSTRACT

The disclosure provides an electrophotographic toner and methods for preparing the same, including a first binder resin, a second binder resin, a colorant, a releasing agent, a charge control agent, and an ionomer, wherein the second binder resin is a resin derived biomass.

16 Claims, 2 Drawing Sheets

ELECTROPHOTOGRAPHIC TONER AND METHOD OF PREPARING ELECTROPHOTOGRAPHIC TONER

CROSS-REFERENCE TO RELATED APPLICATIONS

This application claims the benefit of Korean Patent Application No. 10-2010-0002744, filed in the Korean Intellectual Property Office on Jan. 12, 2010, the disclosure of which is hereby incorporated by reference in its entirety for all purposes.

BACKGROUND

1. Field of the Invention

The disclosure generally relates to an electrophotographic toner and a method of preparing the electrophotographic toner.

2. Description of the Related Art

Developers used to visualize electrostatic images and electrostatic latent images in electrographic and electrostatic processes can be classified into two-component developers and one-component developers. Two-component developers include toner and carrier particles whereas one-component developers consist exclusively of toner. One-component developers can be further classified into magnetic and nonmagnetic developers. In order to increase the fluidity of toner, nonmagnetic one-component developers often contain a fluidizing agent, such as colloidal silica. Typically, coloring particles obtained by dispersing a pigment such as carbon black or other additives in a binding resin are used in these toners.

Methods of preparing toner may be classified into pulverization or polymerization processes. For pulverization processes, polymer, wax, a colorant, and a charge control agent are pre-mixed in a mixer, and the pre-mixed mixture is mixed and melted using an extruder. The resulting particles are sorted until particles of a desired size are obtained, and an external addition process is performed on the particles to prepare the toner. Polymerization processes may be further classified into suspension polymerization and emulsion-aggregation polymerization processes. For suspension polymerization, a monomer, a pigment, and wax are mechanically dispersed in water with a stirrer, and polymerized at an appropriate temperature. In addition, to stably disperse an internal agent such as a pigment, wax, and the like in toner particles, a surfactant such as a stabilizer may be introduced into the toner. The remaining monomer is then removed, and an external addition process is performed in the same manner as in the pulverization process. For emulsion-aggregation, a polymer latex, wax, a pigment, and a charge control agent are aggregated together, and the size of the aggregated particles is adjusted by adjusting the temperature. The resulting particles are stabilized and coalesced by heating, and an external addition process is performed in the same manner as in the pulverization process.

Recently, there has been an increase in demand for strengthening regulations relating to global warming and other environmental regulations, and an increase in pressure for all nations to abide by such regulations and policies. Consumers also tend to buy products depending on whether the products have the "environmentally friendly product" mark. Accordingly, since printers have various environmental regulation requirements, such as the amount of emission of carbon dioxide ($CO_2$), smell, dusts, recyclable plastics, and the like, there has been a demand for more environmentally friendly toner.

SUMMARY

The disclosure provides a more environmentally friendly electrophotographic toner and methods for preparing the electrophotographic toner.

According to one aspect, the disclosure provides an electrophotographic toner including a first binder resin, a second binder resin, a colorant, a releasing agent, a charge control agent, and an ionomer, wherein the second binder resin is a resin derived biomass.

In another aspect the disclosure provides an electrographic toner, wherein the first binder resin is selected from a polystyrene resin, homopolymers of styrene substituents, a styrene-based copolymer resin, an acryl resin, a methacryl resin, a polyacetic acid vinyl resin, a silicon resin, a polyester resin, a polyamide resin, a furan resin, an epoxy resin, a xylene resin, or combination thereof.

In another aspect the disclosure provides an electrographic toner, wherein the first binder resin has a number average molecular weight in the range of about 1,000 to about 120,000; and a softening point in the range of about 90 to about 170° C.

In another aspect the disclosure provides an electrographic toner, wherein the biomass is selected from corns, beans, papers, paper products, waste papers, timbers, particleboards, sawdusts, agricultural wastes, waste waters, silage, grasses, rice husks, bagasses, cottons, jutes, hemps, flaxes, bamboos, sisal hemps, manila hemps, straws, switchgrasses, alfalfas, hays, coconut hairs, synthetic celluloses, seaweeds, algaes, or combination thereof.

In another aspect the disclosure provides an electrographic toner, wherein the second binder resin has a glass transition temperature in the range of about 60 to about 75° C., a softening point in the range of about 99 to about 140° C., an acid value in the range of about 1 to about 20 mg KOH/g, and a number average molecular weight in the range of about 20,000 to about 80,000.

In another aspect the disclosure provides an electrographic toner, wherein the ionomer includes an anionic residue of a carboxylic acid or sulfonic acid, and a corresponding metal ion selected from $Na^+$, $K^+$, $Mg^{2+}$, and $Zn^{2+}$.

In another aspect the disclosure provides an electrographic toner, wherein the ionomer is selected from a polyurethane-based ionomer, a polyester-based ionomer, an acryl-based ionomer, or combination thereof.

In another aspect the disclosure provides an electrographic toner, wherein the ionomer is a sodium salt or zinc salt of poly(ethylene-co-methacrylic acid).

In another aspect the disclosure provides an electrographic toner, wherein the releasing agent has a melting point in the range of about 50° C. to about 150° C.

In another aspect the disclosure provides an electrographic toner, wherein the colorant is selected from carbon black, aniline black, yellow colorant, magenta colorant, and cyan colorant.

In another aspect the disclosure provides an electrographic toner, including about 5 to about 80 parts by weight of the second binder resin, about 0.1 to about 20 parts by weight of the colorant, about 1 to about 20 parts by weight of the releasing agent, about 0.1 to about 10 parts by weight of the charge control agent, and about 0.1 to about 5 parts by weight of the ionomer based on 100 parts by weight of the first binder resin.

In another aspect the disclosure provides an electrographic toner, having a volume average particle diameter in the range of about 4.0 to about 12.0 μm.

According to another aspect, the disclosure provides methods for preparing an electrophotographic toner, by: a) mixing a first binder resin, a second binder resin, a releasing agent, a colorant, a charge control agent, and an ionomer to provide a resultant mixture, wherein the second binder resin is a resin derived from biomass; b) melting, mixing and extruding the resultant mixture to provide an extruded product; c) cooling, solidifying, pulverizing and sorting the extruded product to provide a resultant product; and d) coating the resultant product with an external addition layer comprising silica, metal oxide, and polymer beads to provide the electrographic toner.

In another aspect the disclosure provides methods for preparing an electrophotographic toner, wherein the silica includes large particle silica and small particle silica, wherein the large-particle silica has a primary particle size in the range of about 30 to about 200 nm, and the small-particle silica has a primary particle size in the range of about 5 to about 20 nm.

In another aspect the disclosure provides methods for preparing an electrophotographic toner, wherein the metal oxide is $TiO_2$.

In another aspect the disclosure provides methods for preparing an electrophotographic toner, wherein the polymer beads are spherical, and wherein the polymer beads are selected from a styrene-based resin, a methyl methacrylate resin, a styrene-methyl methacrylate copolymer resin, an acryl-based resin, and an acryl-styrene copolymer resin.

BRIEF DESCRIPTION OF THE DRAWINGS

Various features and advantages of the disclosure will become more apparent by describing in detail exemplary embodiments thereof with reference to the attached drawings in which.

DETAILED DESCRIPTION OF THE EMBODIMENTS

Figure 1:
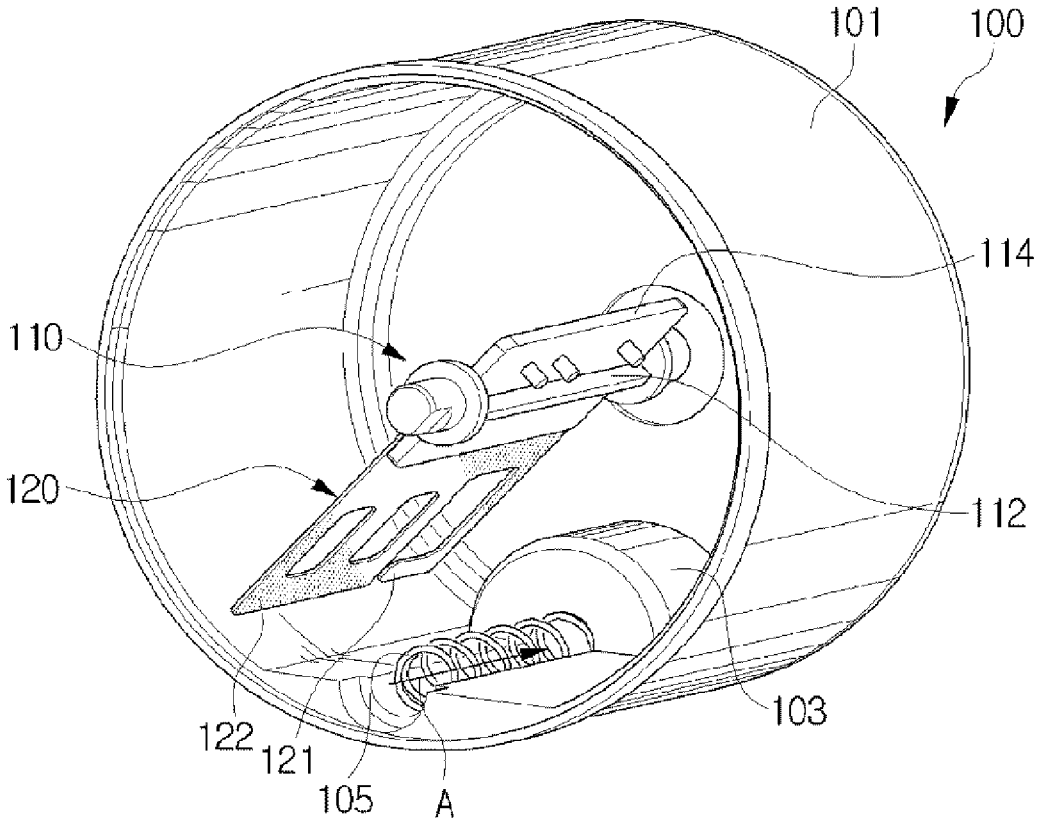
FIG. 1 is a perspective view of a toner supplying unit.

The disclosure will now be described more fully with reference to the accompanying drawings, in which exemplary embodiments of the disclosure are shown.

The disclosure provides an electrophotographic toner that includes a first binder resin, a second binder resin, a colorant, a releasing agent, a charge control agent, and an ionomer, wherein the second binder resin is a resin derived from biomass. The first binder resin may be obtained from at least one reactive compound. The reactive compound may be a radical polymerizable monomer, an ester-condensation polymerizable polyvalent alcohol and a polyvalent carboxylic acid, an amide-condensation polymerizable amine compound and a polyvalent carboxylic acid, a furan resin-forming perfuryl alcohol, an epoxy resin-forming bisphenol A and epichlorohydrin, a xylene resin-forming xylene and formalin, or silicon resin-forming dimethyldichlorosilane and methyltrichlorosilane, but is not limited thereto.

The polymerizable monomer used herein includes, but is not limited to, at least one monomer selected from styrene-based monomers such as styrene, vinyltoluene, α-methylstyrene; acrylic acids, and the like, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide, methacrylamide, and the like; ethylenically unsaturated monoolefines such as ethylene, propylene, butylene, and the like; halogenated vinyls such as vinyl chloride, vinylidene chloride, vinyl fluoride, and the like; vinyl esters such as vinyl acetate, vinyl propionate, and the like; vinyl ethers such as vinylmethylether, vinylethylether, and the like; vinyl ketones such as vinylmethylketone, methylisoprophenylketone, and the like; and a nitrogen-containing vinyl compound such as 2-vinylpyridine, 4-vinylpyridine, N-vinylpyrrolidone, and the like.

Examples of the polyvalent carboxylic acids include, but is not limited to, oxalic acid, malonic acid, succinic acid, glutalic acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenyl-succinic acid, n-octylsuccinic acid, n-octenylsuccinic acid, acid anhydrides, and oxychlorides thereof, and the like.

Examples of the polyvalent alcohols include, but is not limited to, ethyleneglycol, diethyleneglycol, triethyleneglycol, 1,2-propyleneglycol, 1,3-propyleneglycol, 1,4-butandiol, 1,4-butenediol, neopentylglycol, 1,5-pentaneglycol, 1,6-hexaneglycol, 1,4-cyclohexanediol, 1,4-cyclohexanedimethanol, dipropyleneglycol, polyethyleneglycol, polypropyleneglycol, and the like.

The amide-condensation polymerizable amine compound includes, but is not limited to, aromatic diamines, such as phenylene diamine, diethyl toluene diamine, 4,4'-diamino diphenyl methane, and the like; alicyclic diamines, such as 4,4'-diamino-3,3'-dimethyl dicyclohexyl methane, diamine cyclohexane, isophorone diamine, and the like; aliphatic diamines, such as a bivalent amine compound (for example, ethylene diamine, tetramethylene diamine, or hexamethylene diamine), a polyvalent (trivalent or greater) amine compound (for example, diethylene triamine or triethylene tetraamine), and the like.

The first binder resin may include, but is not limited to, polystyrene; homopolymers of styrene substituents, such as poly-p-chlorostyrene, polyvinyltoluene, and the like; styrene-based copolymers, such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-α-chloromethacrylic acid methyl copolymer, a styrene-acrylonitrile copolymer, a styrene-vinylmethylether copolymer, a styrene-vinylethylether copolymer, a styrene-vinylmethylketone copolymer, a styrene-butadiene copolymer, a styrene-isoprene copolymer, a styrene-acrylonitrile-indene copolymer, and the like; an acryl resin; a methacryl resin; polyacetic acid vinyl; a silicon resin; a polyester resin; a polyamide resin; a furan resin; an epoxy resin; an xylene resin, and the like. In addition, the first binder resin may be used alone or in a combination of the compounds described above.

The first binder resin may be at least one polyester resin. By using the polyester resin as the first binder resin, fixation of the toner onto paper at a low temperature and gloss suitable for graphic printing may be obtained, and the toner particles may have enhanced storage stability and charging properties. The polyester resin includes an acid component and an alcohol component. One polyester resin in a particle form or mixtures of at least two of these resins may be used. An equivalent ratio of the acid component to the alcohol component may be in the range of 1:1 to 1:2. The acid component may include an aromatic dibasic acid component, a three or more-valent polyfunctional acid component, and/or a sulfonic acid-containing aromatic dibasic acid component.

The aromatic dibasic acid component includes, but is not limited to, an aromatic dibasic acid and an alkyl ester thereof that are commonly used in preparing the polyester resin. For example, the aromatic dibasic acid may be terephthalic acid, isophthalic acid, and the like, and the alkyl ester of the aromatic dibasic acid may be dimethylterephthalate, dimethylisophthalate, diethylterephthalate, diethylisophthalate, dibutylterephthalate, dibutyliso-phthalate, and the like. The aromatic dibasic acid and the alkyl ester thereof may be used alone or in a combination of the compounds described above.

Examples of the three or more-valent polyfunctional acid component may include, but is not limited to, trimellitic acid, pyromellitic acid, 1,2,4-cyclohexanetricarboxylic acid, 2,5,7-naphthalene-tricarboxylic acid, 1,2,4-naphthalenetricarboxylic acid, 1,2,5-hexanetri-carboxylic acid, 1,2,7,8-octanetetra carboxylic acid, and the like, and at least one of an alkyl ester thereof and an acid anhydride thereof.

The sulfonic acid-containing aromatic dibasic acid component enhances dispersibility and charge control functions of the colorant in the electrophotographic toner, thereby improving images of a copied or printed material. For example, the sulfonic acid-containing aromatic dibasic acid component may be dimethyl 5-sulfoisophthalate sodium salt, 5-sulfoisophthalic acid sodium salt, or a mixture thereof.

The alcohol component of the polyester resin includes, but is not limited to, aliphatic diols, such as 1,2-propanediol, ethyleneglycol, diethyleneglycol, neopentylglycol, 1,4-butanediol, and the like. In particular, 1,2-propanediol may be used to facilitate the adjustment of reactivity during polymerization of the polyester resin.

The polyester resin may have a softening point in the range of about 90 to about 170° C., for example, in the range of about 110 to about 160° C. When the softening point of the polyester resin is within the range of about 90 to about 170° C., the electrophotographic toner may have high durability and storage stability, and high gloss and good fixation to paper of the electrophotographic toner may be obtained.

The polyester resin may have a number average molecular weight in the range of about 1,000 to about 120,000, for example, in the range of about 5,000 to about 50,000. When the number average molecular weight of the polyester resin is within the range of about 1,000 to about 120,000, both durability and fixation to paper of the electrophotographic toner may be enhanced.

The second binder resin may be a resin derived from biomass. The resin derived from biomass, i.e., a biomass resin, refers to a resin that contains a compound with a skeleton constituted by carbon atoms obtained by plant's action to fix carbon dioxide in the air through photosynthesis. Therefore, even if carbon dioxide is emitted as a result of biomass resin combustion, an increase of carbon dioxide in the air may substantially be prevented. It will thus be seen that the electrophotographic toner containing the biomass resin may prevent environmental contamination and can be discarded. Examples of the biomass resin may include, but is not limited to, corns, beans, papers, paper products, waste papers, timbers, particleboards, sawdusts, agricultural wastes, waste waters, silages, grasses, rice husks, bagasses, cottons, jutes, hemps, flaxes, bamboos, sisal hemps, manila hemps, straws, switchgrasses, alfalfas, hays, coconut hairs, synthetic celluloses, seaweeds, algaes, and the like, and mixtures thereof.

The biomass resin may be classified into three groups: a naturally produced resin which may itself be used as a polymer; a chemically synthesized resin obtained through chemical polymerization of biomass-derived polymer and monomer; and a microbiologically produced resin obtained through polymerization in the body of a microorganism.

Examples of the naturally produced resin include, but is not limited to, cellulose acetate, esterified starch, chitosan, fibroin, collagen, gelatine, natural rubber, and the like. Examples of the chemically synthesized resin include, but is not limited to, polyester (for example, polymethyleneterephthalate, polybutylene succinate, and the like) synthesized using natural raw materials such as corns, beans, or other plants, polyamide, polyurethane, polylactic acid, and polyglycol. For example, the polyester resin derived from beans may be BioRez manufactured by Advanced Image Resources, Inc (AIR). Examples of the microbiologically produced resin include, but is not limited to, polyhydroxy butyrate, polyhydroxyalkanoate, bacterial cellulose, polyglutamic acid, and the like. The biomass resin is not particularly limited, and it is possible to use, for example, polylactic acid, polymethyleneterephthalate, polybutylene succinate, polyhydroxy butylrate, polyhydroxyalkanoate, or polyester synthesized with a succinic acid, 1,3-propane diol, or an itaconic acid as a monomer. At least two of these materials may also be used as the biomass resin.

The second binder resin may have a glass transition temperature in the range of about 60 to about 75° C., a softening point in the range of about 99 to about 140° C., an acid value in the range of about 1 to about 20 mg KOH/g, and a number average molecular weight in the range of about 20,000 to about 80,000. In particular, the glass transition temperature of the second binder resin may be in the range of about 60 to about 75° C., for example, in the range of about 63 to about 70° C. When the glass transition temperature of the second binder is within the range described above, the resin derived from biomass may be prepared, and fixation of the obtained electrophotographic toner to paper may be enhanced.

In addition, the softening point of the second binder resin may be in the range of about 99 to about 140° C., for example, in the range of about 107 to about 130° C. When the softening point of the second binder is within the range described above, durability of the obtained electrophotographic toner and fixation thereof to paper may be enhanced, and a streak phenomenon occurring in images printed using the electrophotographic toner may be prevented.

In particular, the second binder resin has the acid value in the range of about 1 to about 20 mg KOH/g, for example, in the range of about 5 to about 15 mg KOH/g. When the acid value of the second binder is within the range described above, the fixation of the obtained electrophotographic toner to paper is enhanced. On the other hand, when the acid value of the second binder is beyond the range, the obtained electrophotographic toner excessively absorbs moisture in the air, and thus it is hydrolyzed in an extruder. As a result, the processability of the second binder resin may be reduced, and, for example, chains of the second binder resin are cut off.

The second binder resin has the number average molecular weight in the range of about 20,000 to about 80,000, for example, in the range of about 30,000 to about 70,000. When the number average molecular weight of the second binder resin is within the range described above, durability of the obtained electrophotographic toner and fixation thereof to paper may be enhanced, and wide distribution of the charging amount of the electrophotographic toner may be prevented.

The amount of the second binder resin may be in the range of about 5 to about 80 parts by weight, for example, in the range of about 10 to about 70 parts by weight based on 100 parts by weight of the first binder resin. When the amount of the second binder resin is within the range described above, environmental contamination problems caused when the electrophotographic toner is discarded may be effectively prevented, and the durability of the electrophotographic toner and fixation thereof to paper may be enhanced.

The colorant for a black toner may be carbon black or aniline black. For a color toner, carbon black is used as a black colorant, and yellow colorant, magenta colorant, and cyan colorant are further included.

The yellow colorant may include, but is not limited to, a condensed nitrogen compound, an isoindolinone compound, an anthraquinone compound, an azo metal complex, an allyl imide compound, and the like. Examples of the yellow colorant include, but is not limited to, C.I. pigment yellows 12, 13, 14, 17, 62, 74, 83, 93, 94, 95, 109, 110, 111, 128, 129, 147, 168, 180, and the like.

Examples of the magenta colorant include, but is not limited to, condensed nitrogen compounds, anthraquinone compounds, quinacridone compounds, base dye lake compounds, naphthol compounds, benzo imidazole compounds, thioindigo compounds, perylene compounds, and the like. Specifically, examples of the magenta colorant include, but is not limited to, C.I. pigment reds 2, 3, 5, 6, 7, 23, 48:2, 48:3, 48:4, 57:1, 81:1, 122, 144, 146, 166, 169, 177, 184, 185, 202, 206, 220, 221, 254, and the like.

Examples of the cyan colorant include, but is not limited to, copper phthalocyanine compounds and derivatives thereof, anthraquinone compounds, base dye lake compounds, and the like. Particularly, examples of the cyan colorant include, but is not limited to, C.I. pigment blues 1, 7, 15, 15:1, 15:2, 15:3, 15:4, 60, 62, 66, and the like.

Such colorants may be used alone or in a combination of at least two colorants, and are selected in consideration of the desired color, chromaticity, luminance, resistance to weather, dispersion property in toner, and the like properties.

The colorant may be used in an amount sufficient enough to colorize the electrophotographic toner. For example, the amount of the colorant may be in the range of about 0.1 to about 20 parts by weight, in particular, in the range of about 2 to about 10 parts by weight based on 100 parts by weight of the first binder resin. When the amount of the colorant is within the range described above, the colorant may have sufficient coloring effects, manufacturing costs of the electrophotographic toner are low, and the friction charging amount of the electrophotographic toner is sufficient.

The charge control agent may be selected from a salicylic acid compound containing a metal such as zinc or aluminum, boron complexes of bis diphenyl glycolic acid, and silicate. More particularly, the charge control agent may be dialkyl salicylic acid zinc, or boro bis(1,1-diphenyl-1-oxo-acetyl potassium salt). The amount of the charge control agent may be in the range of about 0.1 to about 10 parts by weight, for example, in the range of about 1 to about 7 parts by weight based on 100 parts by weight of the first binder resin. When the amount of the charge control agent is within the range described above, a reduction in chargeability of the obtained electrophotographic toner and developing problems caused by overcharging of the toner may be prevented. In addition, when the electrophotographic toner is prepared, pulverization/classification functions are enhanced while the toner is pulverized in a pulverizer/classifier after an extrusion process, thereby increasing the yield of the electrophotographic toner.

The term "ionomer" as used herein refers to a polymer that chains contain a small fraction of ionized groups, wherein the polymer includes nano-sized ion clusters existing therein. When the ionomer is used together with a binder resin, the semi-conductivity of the binder resin and physical properties of a polymer of the binder resin are enhanced. This is attributed to the ionomer having a physically cross-linked structure between molecular chains, that is, a mesh structure. The ionomer is flexible at a high temperature since ionic bonds in the ionomer become less strong, and thus the ionomer may easily be shaped. In addition, when the ionomer is cooled, the ionic bonds in the ionomer are returned to the original state. The ionomer may be shaped using injection molding or extrusion molding, and the electrophotographic toner including the ionomer may have enhanced oil resistance, weather resistance and impact resistance.

The ionomer may be classified into cationomers, anionomers, and zwitterionomers. In addition, the ionomer includes an anionic residue of a carboxylic acid or sulfonic acid and the corresponding metal ion selected from $Na^+$, $K^+$, $Mg^{2+}$, and $Zn^{2+}$. The ionomer may be selected from polyurethane-based ionomer, a polyester-based ionomer, and an acryl-based ionomer.

The polyurethane-based ionomer may be prepared by reacting a hydrophilic group-containing compound, other active hydrogen-containing compounds and polyisocyanate and emulsifying an organic solvent solution or organic solvent dispersion of the obtained hydrophilic group-containing polyurethane resin in water. Alternatively, the polyurethane-based ionomer may be prepared by reacting a hydrophilic group-containing compound, other active hydrogen-containing compounds and polyisocyanate, dispersing the obtained hydrophilic group-containing urethane prepolymer in water, and reacting the resulting solution with polyamine.

Examples of the hydrophilic group-containing compound include, but is not limited to, sulfonic acid-containing compounds, such as 2-oxyethane sulfonic acid, sulfo succinic acid, sulfanilic acid, 2,4-diamino toluene sulfonic acid, and the like; carboxylic acid-containing compounds, such as 2,2-dimethylol propionic acid, dioxymaleic acid, 3,4-diamino benzoic acid, and the like; polyoxyethylene glycol having at least one active hydrogen; and a polyoxyethylene-polyoxy propylene copolymer.

The polyester-based ionomer may be prepared by condensation polymerizing dicarboxylic acid having a sulfonic acid alkali metal salt on its aromatic ring; adding polycarboxylic acid anhydride to polyester and neutralizing the resultant product with a base; condensation polymerizing polyethylene and glycol; or in a combination of the processes described above.

Examples of the dicarboxylic acid having a sulfonic acid alkali metal salt on its aromatic group include, but is not limited to, sulfo terephthalic acid, 5-sulfo isophthalic acid, 4-sulfo naphthalene-2,7 dicarboxylic acid, and the like.

The acryl-based ionomer may be prepared by copolymerizing an ethylenically unsaturated monomer mixture including at least one of an ethylenically unsaturated carboxylic acid monomer and an ethylenically unsaturated sulfonic acid monomer by using a radical polymerization initiator in the presence of an organic solvent and adding a base and water to the obtained copolymer. Alternatively, the acryl-based ionomer may be prepared by suspension polymerizing an ethylenically unsaturated monomer mixture including at least one of an ethylenically unsaturated carboxylic acid monomer and an ethylenically unsaturated sulfonic acid monomer by using a radical polymerization initiator in the presence of a dispersant, separating the obtained copolymer from the resultant product, and adding a base and water to the copolymer.

The ethylenically unsaturated carboxylic acid monomer may be a monocarboxylic acid such as acrylic acid or methacrylic acid; a dicarboxylic acid such as itaconic acid, fumaric acid, maleic acid, or crotonic acid or an anhydride or monoester thereof. The ethylenically unsaturated sulfonic acid monomer may be sulfonic acid such as styrene sulfonic acid, or vinyl sulfonic acid or salts thereof.

The acryl-based ionomer may be a sodium salt or zinc salt of poly(ethylene-co-methacrylic acid) prepared by copolymerizing ethylene and methacrylic acid.

The amount of the ionomer may be in the range of about 0.1 to about 5 parts by weight, for example, in the range of about 0.5 to about 3 parts by weight based on 100 parts by weight of the first binder resin. When the amount of the ionomer is within the range described above, a reduction in charging of the electrophotographic toner occurring when resin derived from biomass is used as the second binder resin may be offset by the ionomer, and the durability of the electrophotographic toner may be enhanced.

The releasing agent may be appropriately selected according to desired properties of electrophotographic toner. Examples of the releasing agent include, but is not limited to, polyethylene-based wax, polypropylene-based wax, silicon wax, paraffin-based wax, ester-based wax, carnauba wax, and metallocene wax.

The releasing agent may be wax having a melting point in the range of about 50° C. to about 150° C. When the releasing agent has the melting point within the range described above, the releasing agent may effectively exhibit releasing properties. As the melting point of the releasing agent is higher, the dispersibility of toner particles decreases, on the other hand, as the melting point of the releasing agent is lower, the dispersibility of toner particles is enhanced. However, considering internal environmental factors of an electrophotographic device including electrophotographic toner and fixation of final printed images to paper, the melting point of the releasing agent may be in the range of about 50° C. to about 150° C. The releasing agent is physically attached to toner particles, but is not covalently bonded with toner particles. The releasing agent enables toner to be fixed to a final image receptor at a low fixing temperature and to have excellent final image durability and abrasion-resistance characteristics.

The amount of the releasing agent may be in the range of about 1 to about 20 parts by weight, for example, in the range of about 1 to about 10 parts by weight based on 100 parts by weight of the first binder resin. When the amount of the releasing agent is within the range described above, the releasing properties and durability of the obtained electrophotographic toner may be enhanced.

The electrophotographic toner may be coated by an external addition layer including an external additive such as silica, metal oxide, or polymer beads.

The amount of the silica may be in the range of about 0.1 to about 10 parts by weight, for example, in the range of about 0.5 to about 5.0 parts by weight based on 100 parts by weight of the first binder resin. When the amount of the silica is within the range described above, the obtained electrophotographic toner may have enhanced fluidity, and image contamination and poor image development may be prevented. The silica is commonly used as a dehumidifying agent, but the function of the silica may depend on the particle size thereof. A silica having a primary particle having a size of about 30 nm to about 200 nm is referred to as a large-particle silica, and a silica having a primary particle having a size of about 5 nm to about 20 nm is referred to as a small-particle silica.

The term "primary particle" as used herein refers to a unit particle of a compound in which polymerization, bonding or the like does not occur. The small-particle silica is mainly added in order to improve the fluidity of toner particles, and the large-particle silica is added in order to charge the toner particles. The silica may include the small-particle silica and the large-particle silica in a predetermined amount or ratio. In other words, the amount of the small-particle silica having a primary particle size in the range of about 5 nm to about 20 nm may be in the range of about 0.05 to about 5 parts by weight based on 100 parts by weight of the first binder resin. On the other hand, the amount of the large-particle silica having a primary particle size in the range of about 30 nm to about 200 nm may be in the range of about 0.05 to about 5 parts by weight based on 100 parts by weight of the first binder resin. The primary particle size of the small-particle silica and the large-particle silica included in the external addition layer are determined by compatibility with toner particles and the size of toner particles themselves. When the total amount of the silica is in the range of about 0.1 to about 10 parts by weight based on 100 parts by weight of the first binder resin, the obtained electrophotographic toner may have enhanced fluidity, and the charge amount of toner particles may easily be adjusted.

The metal oxide, which is one of the externally added agents, includes titanium oxide. The amount of the titanium oxide may be in the range of about 0.1 to about 5 parts by weight, for example, in the range of about 0.5 to about 2.0 parts by weight based on 100 parts by weight of the first binder resin. The titanium oxide may exist in a form having various acid values in addition to the form of $TiO_2$, but $TiO_2$ is the commonest form. Titanium oxide may be dissolved in alkali to become alkali titanate. The titanium oxide is mostly used as a white pigment (titanium white) having a high hiding power, and used in magnetic raw materials, an abrasive, medicines, cosmetics, and the like. The titanium oxide adjusts the excessive charging occurring when only silica is used as an externally added agent. The titanium oxide may be surface-treated with alumina and an organo polysiloxane, and may have a primary particle size in the range of about 10 to about 200 nm. The particle size of the titanium oxide may be determined by the size of toner particles and compatibility with toner particles as described above in the case of silica. The surface-treated titanium oxide may have a BET surface area in the range of about 20 $m^2/g$ to about 100 $m^2/g$.

The external addition layer of the particles of the electrophotographic toner may further include polymer beads as an externally added agent in addition to the metal oxide and silica as described above. A styrene-based resin, a methacrylic acid methyl, a styrene-methacrylic acid methyl copolymer, an acryl-based resin, an acryl-styrene copolymer, and the like may be used alone or in combination as the polymer beads. The polymer beads may be manufactured by a polymerization process such as suspension polymerization and the like, and are formed to be generally spherical. The particle size of the polymer beads may be various sizes in the range of submicrons to tens of microns. The polymer beads may be contained in the external addition layer, in an amount of about 0.1 to about 10 parts by weight, for example, about 0.2 to about 2 parts by weight based on 100 parts by weight of the first binder resin. When the amount of the polymer beads is within the range described above, the obtained electrophotographic toner may have enhanced charging property, and image contamination may be prevented.

The electrophotographic toner may further include various internally and externally added agents in order to improve the functionality of the electrophotographic toner in addition to the added agents as described above. For example, an UV stabilizer, a mold inhibitor, bactericide, fungicide, an antistatic agent, a gloss modifying agent, antioxidant, an anticaking agent such as silane or silicone-modified silica particles, or the like may be selected alone or a combination of at least the two types can be added to the electrophotographic toner as internally or externally added agents. The amount of the internally and externally added agents may be in the range of about 0.1 to about 10 parts by weight based on 100 parts by weight of the first binder resin.

The electrophotographic toner may have a volume average particle diameter in the range of about 4.0 to about 12.0 μm, for example, in the range of about 6.0 to about 9.0 μm. When the volume average particle diameter thereof is within the range described above, an organic photoconductor (OPC) may be satisfactorily cleaned, the yield of the electrophotographic toner may increase. In addition, the toner particles may be uniformly charged, the fixation of the electrophotographic toner onto paper may be enhanced, and a toner layer may easily be controlled using a doctor blade (Dr-Blade).

According to another aspect the disclosure provides methods for preparing an electrophotographic toner, by: a) mixing a first binder resin, a second binder resin, a releasing agent, a colorant, a charge control agent, and an ionomer to provide a resultant mixture, wherein the second binder resin is a resin derived from biomass; b) melting, mixing and extruding the resultant mixture to provide an extruded product; c) cooling, solidifying, pulverizing and sorting the extruded product to provide a resultant product; and d) coating the resultant product with an external addition layer comprising silica, metal oxide, and polymer beads to provide the electrographic toner.

A detailed description of the types and amounts of the first binder resin, the second binder resin, the colorant, the charge control agent, the releasing agent, the ionomer, the silica, the metal oxide, and the polymer beads are already provided.

The mixing of the first binder resin, the second binder resin, the releasing agent, the colorant, the charge control agent, and the ionomer may be performed in a mixer. Examples of the mixer include, but is not limited to, a Henschel mixer, a super mixer, Ribocorn, a Nauta mixer, a turbulizer, a cyclo mixer, a spiral pin mixer, a Lodige mixer, and the like.

The melting and mixing of the resultant mixture to be extruded may be performed using a mixer, such as a heating roll, a kneader, or an extruder. Examples of the mixer include, but is not limited to, a twin screw extruder, a KRC kneader, a Buss co-kneader, a TEM extruder, a TEX biaxial kneader, a PCM mixer, a three-roll mill, a mixing roll mill, a kneader, kneadex, a MS pressure kneader, a kneader-ruder, a Banbury mixer, and the like. When the melting and mixing of the resultant mixture to be extruded is performed using the twin screw extruder, it is very important to adjust a supplying speed and screw speed in the extruder and a melting temperature in the mixer.

The supplying speed may be in the range of about 1 to about 20 rpm, for example, in the range of about 3 to about 10 rpm. When the supplying speed is within the range described above, the time where the resultant mixture stays in the extruder is appropriately adjusted, and thus the fluidity thereof may easily adjusted.

The screw speed may be in the range of about 50 to about 400 rpm, for example, in the range of about 150 to about 200 rpm. When the screw speed is within the range described above, the melting viscosity of the resultant mixture melted and mixed is constantly adjusted, and thus an extruded product with a desired shape may be obtained.

The melting temperature in the extruder may be in the range of about 100 to about 200° C., for example, in the range of about 110 to about 150° C. When the melting temperature is within the range described above, shearing force in the extruder is appropriately adjusted, and thus a binder resin is easily processed. In addition, the resultant mixture is in a uniform mixing state, and the fluidity thereof in a melting state may be adjusted.

As described above, the extruded product is cooled and solidified, and is then pulverized. The pulverizing process may be performed in two operations. In the first operation, the solidified product is pulverized to medium-sized particles having a diameter of several millimeters (mm), and, in the second operation, the pulverized product is finely pulverized to small-sized particles having a diameter of several to tens of micrometers (μm). The further pulverized product in the second operation may be sorted to have a particle size of about 4 to about 10 μm, for example, in the range of about 6 to about 8.

According to another aspect the disclosure provides methods for forming an image, by: attaching toner to a surface of an image carrier (for example, photoreceptor) on which an electrostatic latent image is formed so as to form a visualized image; and transferring the visualized image onto a transfer medium, wherein the electrophotographic toner described above, including a first binder, a second binder, a colorant, and a releasing agent, is used.

A representative electrophotographic imaging process includes a series of forming an image on a receptor, including charging, exposure-to-light, developing, transferring, fixing, cleaning, and erasing processes.

In the charging process, a surface of an image carrier is charged with negative or positive charges, whichever is desired, by a corona or a charge roller. In the exposure-to-light process, the charged surface of the photoreceptor is selectively discharged using a laser scanner or an array of diodes in an image-wise manner in order to form a latent image corresponding to a final visual image to be formed on a final-image receptor. Electromagnetic radiation that may be referred to as "light radiation" may include infrared radiation, visible light radiation, and ultraviolet radiation.

In the developing process, toner particles having an appropriate polarity contact the latent image on the image carrier. To this end, an electrically-biased developer having the same potential polarity as the polarity of toner particles may be used. Toner particles move to the image carrier, selectively adhere to the latent image due to an electrostatic force, and thus form a toner image on the image carrier.

In the transferring process, toner image is transferred from the image carrier to the image receptor where a final image is formed. In some cases, an intermediate transferring element may be used to aid the transfer of toner image from the image carrier to the final-image receptor.

In the fixing process, the toner image on the final-image receptor is heated to soften or melt toner particles, thereby fixing the toner image to the final-image receptor. An alternative fixing method may involve fixing the toner image to the final-image receptor under high pressure with or without the application of heat.

In the cleaning process, residual toner remaining on the image carrier is removed.

Finally, in the charge-erasing process, the charges on the image carrier are exposed to light having a specific wavelength, and thus are uniformly erased resulting in a substantially lower amount of charges on the image carrier. Therefore, the residue of the latent image may be removed, and the image carrier is made available for a further image-forming cycle.

According to another aspect of the disclosure, a toner supplying unit includes: a toner tank in which toner is stored; a supplying part protruding from an inner surface of the toner tank to externally supply toner from the toner tank; and a toner-agitating member rotatably disposed inside the toner tank to agitate toner in almost the entire inner space of the toner tank including a top surface of the supplying part, wherein the electrophotographic toner described above, including a first binder, a second binder, a colorant, and a releasing agent, is used.

FIG. 1 is a view of a toner supplying unit 100. The toner supplying unit 100 includes a toner tank 101, a supplying part 103, a toner-conveying member 105, and a toner-agitating member 110. The toner tank 101 is configured to store therein a predetermined amount of toner, and may have a substantially hollow cylindrical shape. The supplying part 103 may be disposed on an inner bottom surface of the toner tank 101, and may be configured to externally discharge toner contained in the toner tank 101. For example, the supplying part 103 may protrude from the bottom of the toner tank 101 to have a pillar shape with a semi-circular cross-section. The supplying part 103 may include a toner outlet (not shown) in an outer side thereof, through which toner outlet the toner may be discharged.

The toner-conveying member 105 may be disposed at a side of the supplying part 103 on the inner bottom surface of the toner tank 101. The toner-conveying member 105 may have, for example, a coil spring shape. An end of the toner-conveying member 105 may extend inside the supplying part 103 so that toner in the toner tank 101 is conveyed into the supplying part 103 as toner-conveying member 105 rotates. Toner conveyed by the toner-conveying member 105 may be externally discharged through the toner outlet of the supplying part 103.

The toner-agitating member 110 is rotatably disposed inside the toner tank 101 and forces toner in the toner tank 101 to move in a radial direction. For example, when the toner-agitating member 110 rotates at a middle of the toner tank 101, toner in the toner tank 101 is agitated to prevent toner from solidifying. As a result, toner moves down to the bottom of the toner tank 101 due to gravity. The toner-agitating member 110 includes a rotation shaft 112 and a toner-agitating film 120. The rotation shaft 112 is rotatably disposed at the middle of the toner tank 101, and may have a driving gear (not shown) that may be coaxially coupled with an end of the rotation shaft 112 protruding from a side of the toner tank 101. Therefore, the rotation of the driving gear causes the rotation shaft 112 to rotate. Also, the rotation shaft 112 may have a support plate 114 to help fix toner-agitating film 120 to the rotation shaft 112. The support plate 114 may be formed to be substantially symmetric about the rotation shaft 112. The toner-agitating film 120 has a width corresponding to the inner length of the toner tank 101. Furthermore, the toner-agitating film 120 may be elastically deformable in consideration of the shape of a projection inside the toner tank 101, i.e., the supply part 103. The toner-agitating film 120 may include a first agitating part 121 and a second agitating part 122 formed by cutting an end of the toner-agitating film 120 toward the rotation shaft 112 by a predetermined length.

According to another aspect of the disclosure, an imaging apparatus includes: an image carrier; an imaging unit forming an electrostatic image on the surface of the image carrier; a unit containing toner; a toner supplying unit supplying toner to the surface of the image carrier to develop the electrostatic image into a toner image; and a toner transfer unit transferring the toner image formed on the surface of the image carrier to a transfer medium, wherein the electrophotographic toner described above, including a first binder, a second binder, a colorant, and a releasing agent, is used.

Figure 2:
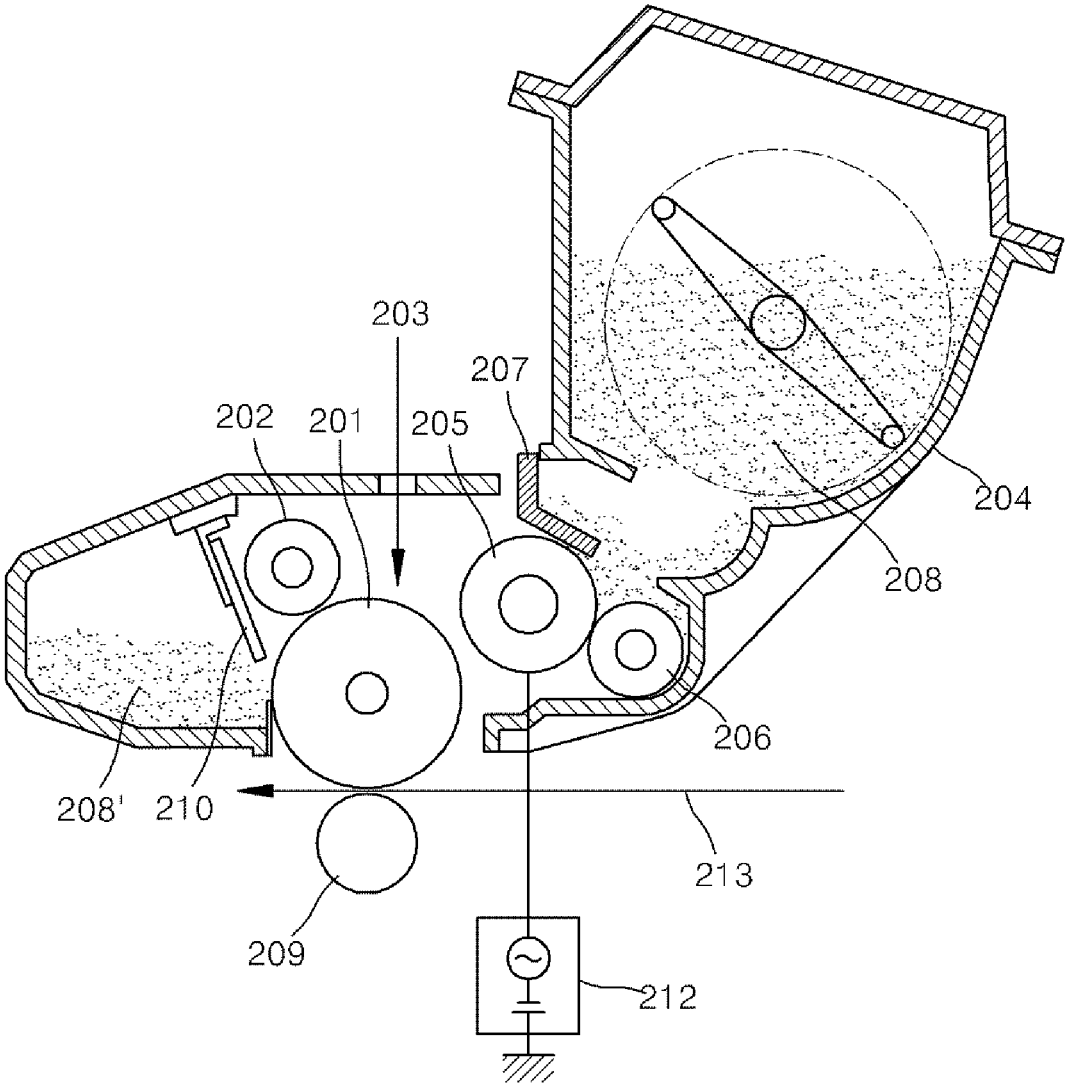
FIG. 2 is a schematic view of a toner imaging apparatus.

FIG. 2 is a schematic view of a non-contact development type imaging apparatus utilizing toner prepared by a method of the disclosure. A non-magnetic one-component developer, i.e., toner 208, in a developing device 204 is supplied to a developing roller 205 by a supply roller 206 formed of an elastic material, such as polyurethane foam or sponge. The toner 208 supplied onto the developing roller 205 reaches a contact portion between a developer-regulating blade 207 and the developing roller 205 as the developing roller 205 rotates. The developer-regulating blade 207 may be formed of an elastic material, such as metal or rubber. When the toner 208 passes through the contact portion between the developer-regulating blade 207 and the developing roller 205, the amount of toner 208 may be regulated to be a thin layer of a uniform thickness, and may also be sufficiently charged. Toner 208 that has been formed into a thin layer is transferred to a development region of a photoreceptor 201 where a latent image on the surface of the photoreceptor 201 is developed with the toner supplied by the developing roller 205, wherein the photoreceptor 201 is an example of an image carrier. As previously described, the electrostatic latent image is formed by scanning light 203 onto the photoreceptor 201.

The developing roller 205 is arranged to face the photoreceptor 201 while being spaced apart from the photoreceptor 201 by a predetermined distance. The developing roller 205 and the photoreceptor 201 may rotate in opposite directions with respect to each other. For example, the developing roller 205 may rotate in a counterclockwise direction while the photoreceptor 201 may rotate in a clockwise direction.

The toner 208, which has been transferred to the development region of the photoreceptor 201, develops the latent image formed on the photoreceptor 201 into a toner image using an electrostatic force generated due to the potential difference between a direct current (DC)-biased alternating current (AC) voltage applied to the developing roller 205 and the latent potential of the photoreceptor 201 charged by a charging unit 202.

Toner image, which has been developed on the photoreceptor 201, reaches a transfer unit 209 as the photoreceptor 201 rotates. Toner image, which has been developed on the photoreceptor 201, is transferred to a print medium 213 when the print medium 213 passes between the photoreceptor 201 and the transfer unit 209, by the transfer unit 209 having a roller shape and to which a high voltage having a polarity opposite to toner 208 is applied.

Toner image transferred to the print medium 213 passes through a high-temperature, high-pressure fusing device (not shown), and thus is fused to the print medium 213, thereby resulting in a fixed image. The non-developed, residual developer 208' on the developing roller 205 is collected by the supply roller 206 contacting the developing roller 205 whereas the non-developed, residual developer 208' on the photoreceptor 201 is collected by a cleaning blade 210. The processes described above may be repeated for formation of subsequent images.

Hereinafter, the embodiments of the disclosure will be described in more detail with reference to the following examples. However, these examples are not intended to limit the scope of the embodiments of the disclosure.

EXAMPLE 1

80 parts by weight of a polyester-based resin used as a first binder resin, which has a glass transition temperature (Tg) of 69° C., a softening temperature (Ts) of 135° C., a Gel amount of 4%, a number average molecular weight (Mn) of 8,500, and a molecular weight polydispersity index (MWD) of 7 (manufactured by Samyang Co., Ltd), 20 parts by weight of BioRez used as a second binder resin (manufactured by AIR (Advanced Image Resources, Inc)), 3 parts by weight of a long-chain ester wax used as a releasing agent (Product name: WE-3, manufactured by NOF), 5 parts by weight of a black pigment used as a colorant (Product name: Mogul-L, manufactured by Cabot), 2.5 parts by weight of an Fe-based charge control agent (Product name: T-77, manufactured by Hodogaya), and 2 parts by weight of Surlyn used as an ionomer, manufactured by Dupont, were premixed in a Henschel mixer for ten minutes. The resultant mixture was extruded in a modular corotating twin screw extruder including two regions of kneading blocks at a supplying speed of 3 rpm, a screw speed of 200 rpm, a screw torque of 80%, a temperature of 130 to 140° C. for an average remaining time of 4 kg/hr. The extruded product was cooled and coarsely crushed, and pulverized into medium-sized particles having a diameter of 1-2 mm using a Bantam Mill, finely pulverized into small-sized particles having a diameter of several to tens of μm in a pulverizing device (SR-15) and a sorting device (TR-15), and then sorted to particles having a diameter of 6 to 9 μm.

1 part by weight of a large-particle silica (manufactured by Wacker Chemical, Product name: H05TD), 1 part by weight of a small-particle silica (manufactured by Degussa, Product name: RX300), 0.1 parts by weight of TiO2, and 0.1 parts by weight of melamine-based polymer beads (manufactured by Nippon Shokubai, Product name: S) were mixed with 180 parts by weight of the sorted resultant product at 3800 rpm for 5 minutes to prepare an electrophotographic toner.

EXAMPLE 2

An electrophotographic toner was prepared in the same manner as in Example 1, except that 60 parts by weight of the first binder resin and 40 parts by weight of the second binder resin were used.

COMPARATIVE EXAMPLE 1

An electrophotographic toner was prepared in the same manner as in Example 1, except that the ionomer was not used.

Evaluation of Toner—Durability Evaluation

A laser printer (manufactured by Samsung Electronics, Product name: color laser 660) was operated under conditions of 2% coverage, 75% duty, a delay time of 20 seconds, and then it was confirmed whether image quality was good or bad, i.e., whether vertical streak occurs on images or not.

Evaluation Criteria

O: no poor images while more than 4,000 sheets of paper were printed

Δ: no poor images while 3,000 to 4,000 sheets of paper were printed

X: poor images existed while less than 3,000 sheets of paper were printed

Fixability Evaluation

Equipment: Belt-type fixing device (Color Laser 660 available from Samsung Electronics Co., Ltd.)

Unfixed image for testing: 100% pattern

Test temperature: 100 to 200° C. (10° C. interval)

Fixing rate: 160 mm/sec

Fixing time: 0.08 sec

This experiment was performed under the conditions described above, and then the fixability of the fixed image was evaluated in the following manner.

Optical density (OD) of the fixed image was measured and then, a 3M 810 tape was attached to the fixed image and 500 g of a weight was reciprocated thereon five times and the tape used was removed. Then, the OD of the fixed image was measured.

Fixability(%)=(OD after peeling off the tape)/(OD before peeling off the tape)×100

Charge Property Evaluation

In the durability evaluation described above, the laser printer was stopped after every 500 sheets of paper were printed, and then a cartridge in the laser printer was disassembled. Then, toner on a developing roller was sucked in a constant zigzag pattern by air suction and a charge amount (μC/g) of the sucked toner per unit area was measured (μC/g).

Evaluation Criteria

O: −35 to −45 μC/g

Δ: −20 to less than −35 μC/g

X: more than −20 μC/g

The durability, fixability, and charge property of each of the electrophotographic toners prepared according to Examples 1 and 2 and Comparative Example 1 were evaluated, and the results are shown in Table 1 below:

TABLE 1

| | Durability | Fixability (%) | Charge Property |
|---|---|---|---|
| Example 1 | ○ (5,000 sheets) | 95 | ○ |
| Example 2 | ○ (4,000 sheets) | 95 | ○ |
| Comparative Example 1 | X (2,000 sheets) | 95 | X |

As seen from the results, the electrophotographic toner of Comparative Example 1 including a resin derived from biomass used as a second binder resin and excluding the ionomer, has decreased charge property and durability. On the other hand, the electrophotographic toners of Examples 1 and 2 including both the second binder resin and the ionomer have excellent durability, fixability and charge property.

As described herein, an electrophotographic toner includes a resin derived from biomass, and thus when the toner is discarded in soil after printed on a medium such as paper, the toner is biodegraded. The electrophotographic toner does not cause environmental pollution and is environment-friendly. In addition, the electrophotographic toner may be used as a new alternative as the development of environment-friendly toner has been required globally and a demand for legislation on the toner has increased.

While the disclosure has been particularly shown and described with reference to exemplary embodiments thereof, it will be understood by those of ordinary skill in the art that various changes in form and details may be made therein without departing from the spirit and scope of the disclosure as defined by the following claims.

What is claimed is:

1. An electrophotographic toner comprising a first binder resin with a number average molecular weight in the range of about 1000 to about 120,000, a second binder resin, a colorant, a releasing agent, a charge control agent, and an ionomer, wherein the second binder resin is a resin derived from biomass.

2. The electrophotographic toner of claim 1, wherein the first binder resin is selected from a polystyrene resin, homopolymers of styrene substituents, a styrene-based copolymer resin, an acryl resin, a methacryl resin, a polyacetic acid vinyl resin, a silicon resin, a polyester resin, a polyamide resin, a furan resin, an epoxy resin, a xylene resin, or combination thereof.

3. The electrophotographic toner of claim 1, wherein the first binder resin has a softening point in the range of about 90 to about 170° C.

4. The electrophotographic toner of claim 1, wherein the biomass is selected from corns, beans, papers, paper products, waste papers, timbers, particleboards, sawdusts, agricultural wastes, waste waters, silages, grasses, rice husks, bagasses, cottons, jutes, hemps, flaxes, bamboos, sisal hemps, manila hemps, straws, switchgrasses, alfalfas, hays, coconut hairs, synthetic celluloses, seaweeds, algaes, or combination thereof.

5. The electrophotographic toner of claim 1, wherein the second binder resin has a glass transition temperature in the range of about 60 to about 75° C., a softening point in the range of about 99 to about 140° C., an acid value in the range of about 1 to about 20 mg KOH/g, and a number average molecular weight in the range of about 20,000 to about 80,000.

6. The electrophotographic toner of claim 1, wherein the ionomer comprises an anionic residue of a carboxylic acid or sulfonic acid, and a corresponding metal ion selected from $Na^+$, $K^+$, $Mg^{2+}$, and $Zn^{2+}$.

7. The electrophotographic toner of claim 1, wherein the ionomer is selected from a polyurethane-based ionomer, a polyester-based ionomer, an acryl-based ionomer, or combination thereof.

8. The electrophotographic toner of claim 1, wherein the ionomer is a sodium salt or zinc salt of poly(ethylene-co-methacrylic acid).

9. The electrophotographic toner of claim 1, wherein the releasing agent has a melting point in the range of about 50° C. to about 150° C.

10. The electrophotographic toner of claim 1, wherein the colorant is selected from carbon black, aniline black, yellow colorant, magenta colorant, and cyan colorant.

11. The electrophotographic toner of claim 1, comprising about 5 to about 80 parts by weight of the second binder resin, about 0.1 to about 20 parts by weight of the colorant, about 1 to about 20 parts by weight of the releasing agent, about 0.1 to about 10 parts by weight of the charge control agent, and about 0.1 to about 5 parts by weight of the ionomer based on 100 parts by weight of the first binder resin.

12. The electrophotographic toner of claim 1, having a volume average particle diameter in the range of about 4.0 to about 12.0 μm.

13. A method of preparing the electrophotographic toner of claim 1, the method comprising the steps of:

a) mixing a first binder resin, a second binder resin, a releasing agent, a colorant, a charge control agent, and an ionomer to provide a resultant mixture, wherein the second binder resin is a resin derived from biomass;

b) melting, mixing and extruding the resultant mixture to provide an extruded product;

c) cooling, solidifying, pulverizing and sorting the extruded product to provide a resultant product; and d) coating the resultant product with an external addition layer comprising silica with large particle silica that has a primary particle size in the range of about 30 to about 200 nm, metal oxide, and polymer beads to provide the electrographic toner.

14. The method of claim 13, wherein the silica further comprises small particle silica, wherein the small-particle silica has a primary particle size in the range of about 5 to about 20 nm.

15. The method of claim 13, wherein the metal oxide is $TiO_2$.

16. The method of claim 13, wherein the polymer beads are spherical, and wherein the polymer beads are selected from a styrene-based resin, a methyl methacrylate resin, a styrene-methyl methacrylate copolymer resin, an acryl-based resin, and an acryl-styrene copolymer resin.

* * * * *